US008006351B2

(12) United States Patent
Baker

(10) Patent No.: US 8,006,351 B2
(45) Date of Patent: Aug. 30, 2011

(54) SHORT-HANDLED, ERGONOMIC GARDEN TOOLS

(75) Inventor: Bruce Baker, Ann Arbor, MI (US)

(73) Assignee: Radius Garden LLC, Ann Arbor, MI (US)

( * ) Notice: Subject to any disclaimer, the term of this patent is extended or adjusted under 35 U.S.C. 154(b) by 0 days.

(21) Appl. No.: 12/951,566

(22) Filed: Nov. 22, 2010

(65) Prior Publication Data

US 2011/0061883 A1 Mar. 17, 2011

Related U.S. Application Data

(63) Continuation of application No. 12/343,899, filed on Dec. 24, 2008, now Pat. No. 7,836,557, which is a continuation of application No. 10/821,766, filed on Apr. 9, 2004, now abandoned.

(51) Int. Cl.
*B25G 1/10* (2006.01)

(52) U.S. Cl. ..... 16/430; 16/110.1; 16/429; 16/436; 15/143.1

(58) Field of Classification Search ..... 16/430, 16/110.1, 429, 436; 15/143.1
See application file for complete search history.

(56) References Cited

U.S. PATENT DOCUMENTS

| | | | |
|---|---|---|---|
| D22,315 | S | 3/1893 | Warner |
| 595,438 | A | 12/1897 | Hall |
| 1,529,835 | A | 3/1925 | Hamilton |
| 1,762,718 | A | 6/1930 | Hervey |
| 2,317,453 | A | 4/1943 | Graham |
| D142,468 | S | 10/1945 | Bremer |
| D180,018 | S | 4/1957 | Greiner |
| 2,787,945 | A | 4/1957 | Greiner |
| 2,843,359 | A | 7/1958 | Franz et al. |
| 3,039,126 | A | 6/1962 | Kessler |
| 3,078,604 | A | 2/1963 | Neuman |
| 3,888,501 | A | 6/1975 | McChesney |
| 3,945,065 | A | 3/1976 | Dushku |
| D256,542 | S | 8/1980 | Nadle |
| D256,979 | S | 9/1980 | Nadle |
| D257,551 | S | 11/1980 | Nadle |
| D262,259 | S | 12/1981 | Terpening |
| D292,865 | S | 11/1987 | Scott |
| 4,704,758 | A | 11/1987 | Hoffman |
| 4,786,095 | A | 11/1988 | Dumont |

(Continued)

*Primary Examiner* — Carlos Lugo
*Assistant Examiner* — Mark Williams
(74) *Attorney, Agent, or Firm* — Gifford, Krass, Sprinkle, Anderson & Citkowski, P.C.

(57) ABSTRACT

Handles allow hand tools, implements or other utensils to operate within their arc of natural use, motion and attack without requiring extension, flexion, radial deviation, or ulnar deviation of the wrist from the neutral plane of the forearm. The preferred embodiments further include a grip shaped to increase the effectiveness of the tool and minimize antagonism between muscles and tendons of the wrist, forearm and upper arm, while maximizing the effectiveness of the gripping force delivered to it by the user. Maintaining the wrist and forearm in a neutral position increases a tool user's potential strength by increasing the synergy between large muscles of the forearm and upper arm and shoulders. It also decreases compression of the tendons and nerves in the carpal tunnel and between the wrist and forearm. Grips according to the invention preferably conform in shape, diameter and dimensions to the physical architecture of the hand such that grip tension and compression of the tendons in the wrist and forearm is optimized, minimizing the compressive force on the small muscles, tendons, and ligaments of the fingers, hand, wrist, and forearm, while maximizing the contributive effectiveness of the larger muscles of the forearm, upper arm and shoulder.

10 Claims, 9 Drawing Sheets

U.S. PATENT DOCUMENTS

| | | | |
|---|---|---|---|
| D305,496 | S | 1/1990 | Jasperson |
| D305,497 | S | 1/1990 | Jasperson |
| D308,157 | S | 5/1990 | Maxian |
| 4,950,013 | A | 8/1990 | Yonkers |
| 4,958,407 | A | 9/1990 | Johnson |
| D313,359 | S | 1/1991 | Riley |
| 5,060,343 | A | 10/1991 | Nisenbaum |
| 5,120,098 | A | 6/1992 | Childress |
| 5,125,130 | A | 6/1992 | Stanish |
| 5,133,101 | A | 7/1992 | Hauser et al. |
| 5,153,966 | A | 10/1992 | Godwin |
| 5,165,144 | A | 11/1992 | Nisenbaum |
| D343,555 | S | 1/1994 | Bonner, III |
| D353,752 | S | 12/1994 | Page |
| D359,605 | S | 6/1995 | Janikowski |
| D360,122 | S | 7/1995 | Rich et al. |
| 5,446,507 | A | 8/1995 | Chang |
| 5,467,590 | A | 11/1995 | Mencarelli et al. |
| 5,471,700 | A | 12/1995 | Pereira |
| D370,612 | S | 6/1996 | Meakin et al. |
| 5,533,768 | A | 7/1996 | Mitchell |
| D376,742 | S | 12/1996 | Filowiak et al. |
| 5,695,011 | A | 12/1997 | Daniels |
| 5,706,553 | A | 1/1998 | Riley et al. |
| 5,716,087 | A | 2/1998 | Backich et al. |
| D395,582 | S | 6/1998 | Smith |
| 5,771,535 | A | 6/1998 | Blessing |
| 5,782,518 | A | 7/1998 | Scruggs |
| 5,791,006 | A | 8/1998 | Anctil |
| 5,791,708 | A | 8/1998 | Capriotti |
| 5,802,960 | A | 9/1998 | Graj et al. |
| 5,810,408 | A | 9/1998 | Armstrong |
| 5,816,337 | A | 10/1998 | Kun-Chuan |
| D411,420 | S | 6/1999 | Rose |
| D411,673 | S | 6/1999 | Biggs et al. |
| 5,920,944 | A | 7/1999 | Biggs et al. |
| D413,234 | S | 8/1999 | Spear |
| 5,947,039 | A | 9/1999 | Lundgren et al. |
| 5,964,451 | A | 10/1999 | Sudheimer |
| 6,023,924 | A | 2/2000 | Babineau |
| 6,062,320 | A | 5/2000 | Pinto et al. |
| D429,072 | S | 8/2000 | Winge |
| D433,890 | S | 11/2000 | Scaringella |
| 6,199,245 | B1 | 3/2001 | Blessing |
| D458,721 | S | 6/2002 | Clarke |
| D458,873 | S | 6/2002 | Choi et al. |
| 6,513,929 | B2 | 2/2003 | Chang |
| 6,598,266 | B1 | 7/2003 | Elliott |
| D482,875 | S | 12/2003 | Greenberg |
| D483,185 | S | 12/2003 | Greenberg |
| 6,662,406 | B2 | 12/2003 | Shonfeld et al. |
| D487,010 | S | 2/2004 | Marquardt et al. |
| 6,684,459 | B2 | 2/2004 | Dickhaus |
| 6,742,222 | B2 | 6/2004 | Furr-Britt et al. |
| 7,836,557 | B2 * | 11/2010 | Baker ..... 16/430 |
| 2003/0131448 | A1 | 7/2003 | Dickhaus |

* cited by examiner

SHORT-HANDLED, ERGONOMIC GARDEN TOOLS

REFERENCE TO RELATED APPLICATIONS

This application is a continuation of U.S. patent application Ser. No. 12/343,899, filed Dec. 24, 2008, which is a continuation of U.S. patent application Ser. No. 10/821,766, filed Apr. 9, 2004, now abandoned. The entire content of application is incorporated herein by reference.

FIELD OF THE INVENTION

This invention relates generally to hand tools and, in particular, to handle designs for garden tools, and the like, which maintain the wrist and/or forearm in a neutral position.

BACKGROUND OF THE INVENTION

Most lawn and garden implements, including shovels, rakes, trowels, and so forth, use conventional, straight handles because they are easily manufactured. Straight handles are not energy efficient, however, because the user must grip the handle to prevent it from sliding in the user's hands. To prevent blisters and fatigue, the user must increase the grip pressure on the handle, resulting in greater stress on the muscles, tendons, joints and limbs. Various types of angled handles have been developed in an attempt to overcome these drawbacks. Angled handles try to take advantage of a user's body shape and position the arm, wrist, hand and torso in a more relaxed posture.

As one example of many, U.S Pat. No. 5,771,535 discloses a utility handle for use with a plurality of implements. The handle includes a shaft portion and a handle portion, the handle portion including a plurality of grip portions. The grip portions are positioned such that the user may grasp the handle in a variety of comfortable and ergonomic positions to relieve stress and fatigue occurring during use. In general, the handle includes two portions; an elongated shaft portion and a handle portion. The handle portion includes at least one handhold or grip portion positioned perpendicular or at a slight angle to a longitudinal axis or centerline of the shaft portion. In the preferred embodiment, the handle section includes three grip portions. Two of the grip portions extend perpendicular to the longitudinal axis of the shaft portion. The third grip portion extends outward at an angle from the longitudinal axis of the shaft portion. The third grip portion allows the user to position one hand at an angle to the longitudinal axis of the shaft portion while the other hand is positioned perpendicular to the longitudinal axis of the shaft portion. Grasping the handle in this position; i.e., placing the user's hands where indicated, enables the user to transmit increased energy to the implement while minimizing nonproductive or wasted energy in the form of friction or gripping force.

In terms of shorter, single-handed tools, U.S. Pat. No. 4,950,013 teaches a trowel which is easily inserted into the ground, and is easily rotatable by virtue of an offset handle and an asymmetric blade structure. This purportedly permits easy loosening of earth around plants and the like through the utilization of a handle which is substantially offset from the center line of the trowel to simultaneously provide a pushing post and a lever arm such that the heel of the palm is utilized to press the point of the trowel into the earth. This same offset handle is utilized along with an asymmetric trowel blade to permit easy rotation of the blade, such that upon insertion, the trowel may be rotated by the side or heel of the hand due to the lever arm provided by the offset handle, so as to easily rotate the blade even after insertion of the blade into packed, hardened earth.

U.S. Pat. No. 5,606,372 is directed to a handgrip device for use with tools and utensils. The primary handgrip has multiple angles by which the hand can grip the shaft of a tool or utensil, thus making the grip ergonomically efficient. When used in combination with a secondary cross-handle, a tool or utensil can become quite easy to use and comfortable to operate. The primary handgrip device of this invention has a grip that slides over, or is made integral with, the end of the shaft of a tool or utensil. The handgrip has a multiply-angled surface, in which the primary hand can assume a substantially straight-angled position (180 degree angle) with respect to the axis of the wrist. The correct hand position varies with each tool. and with each work surface. The proper grip angle for a particular task allows the hand to maintain a straight angle with respect to the wrist axis, while also imparting the driving force of the arm into the shaft of the tool.

U.S. Pat. No. 6,662,406 resides in a garden tool including a work-engaging head joined by a shank to a plastic handle. The handle has a relatively rigid plastic core body. A cavity is formed in the handle to divide it into forward and rearward portions. The cavity is filled with a flexible and resilient material to accommodate flexing of the rearward portion relative to the forward portion. A flexible and resilient gripping sheath covers the outer surface of the core body except for the cavity. In one embodiment the cavity is in the core body and includes a notch. For digging tools, such as trowels, the notch is formed on the lower side of the core body adjacent to the distal end, while for pulling or raking tools, such as plows, the notch is formed on the upper side of the core body adjacent to the working end. A recess may be formed in the core body opposite the notch for cooperation with the notch to define a narrow hinge. In another embodiment the cavity includes an aperture extending laterally through a lobe extension of the grip sheath, and in yet in another embodiment the cavity includes notches formed on upper and lower sides of the core body and defined by a hinge interconnecting the forward and rearward portions of the handle.

Practically every hand tool has a natural arc of attack and motion associated with it. Typically there is a primary line of attack within a plane and a larger range of motion within that plane, with end points. The end points may describe an 80 to 100 degree arc for a short handled garden tool. Longer handled tools may have a broader natural arc of attack.

SUMMARY OF THE INVENTION

This invention addresses the natural arc of attack and motion associated with hand tool design by providing a methodology for implementing an ergonomic hand grip for tools, implements or other utensils. The invention broadly facilitates the use by a hand of such tools, implements or other utensils within their arc of natural use, motion and attack without requiring extension, flexion, radial deviation, or ulnar deviation of the wrist from the neutral plane of the forearm.

The preferred embodiments further include a grip shaped to increase the effectiveness of the tool and minimize antagonism between muscles and tendons of the wrist, forearm and upper arm, while maximizing the effectiveness of the gripping force delivered to it by the user.

Maintaining the wrist and forearm in a neutral position increases a tool user's potential strength by increasing the synergy between large muscles of the forearm and upper arm and shoulders. It also decreases compression of the tendons and nerves in the carpal tunnel and between the wrist and forearm.

Grips according to the invention preferably conform in shape, diameter and dimensions to the physical architecture of the hand such that grip tension and compression of the tendons in the wrist and forearm is optimized, minimizing the compressive force on the small muscles, tendons, and ligaments of the fingers, hand, wrist, and forearm, while maximizing the contributive effectiveness of the larger muscles of the forearm, upper arm and shoulder.

DETAILED DESCRIPTION OF THE INVENTION

As discussed in the Summary of the Invention, this invention facilitates the use of tools, implements or other utensils within their arc of natural use, motion, and/or attack, preferably without requiring extension, flexion, radial deviation, or ulnar deviation of the wrist from the neutral plane of the forearm. In accordance with the invention, with respect to any pushing, pulling, lifting or turning exertion, the wrist and forearm are aligned and centered on the optimal line of attack, such that a line drawn through the center of, and parallel to, the radius and ulna passes through the center of the wrist, through the center of the circumference of the grip, and through the gravitational center of the combined tool, implement (or other utensil) and payload.

Particularly in the case of any pushing, pulling or lifting motion, the line of attack is oriented through the point of maximum exertive force, such that the effective compressive grip force required to use the tool, implement or other utensil within its arc of natural use, motion, and attack is minimized. In some embodiments of the invention, it may not be possible to accommodate an exact 180 degree angle depending on the use of the tool; nevertheless, the tool should be designed to come as close as possible to this primary line of attack.

Figure 1:
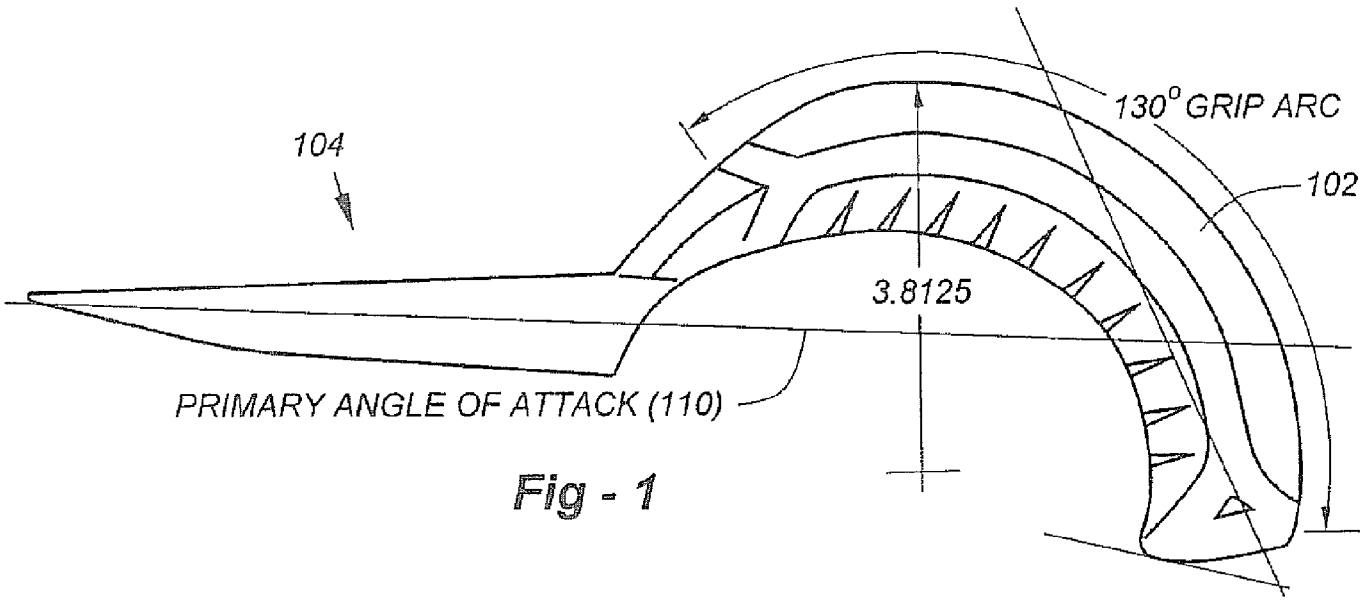
FIG. 1 is a drawing of an embodiment of the invention adapted for use with shorter, single-hand-operated tools such as trowels.
Figure 2:
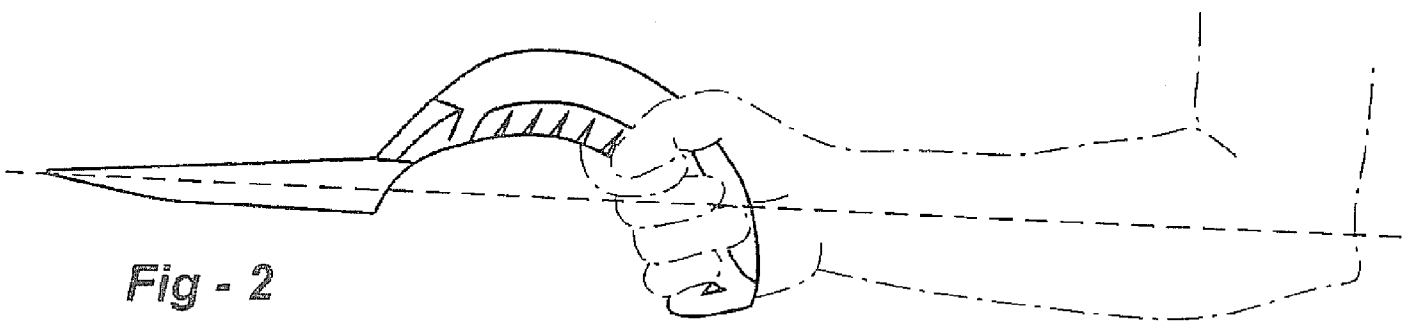
FIG. 2 shows the tool of FIG. 1 being held by a user.
Figure 3:
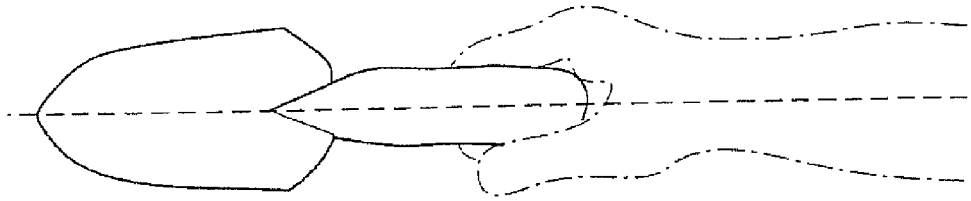
FIG. 3 is a top-down view of a tool depicted in FIGS. 1 and 2.

In accordance with this general philosophy, an ergonomic hand grip for tools, implements, other utensils, according to the invention will now be described in greater detail. FIG. 1 is a drawing of a preferred embodiment of the invention adapted for use with shorter, single-hand-operated tools such as trowels, and the like. FIG. 2 illustrates the tool of FIG. 1 being held by a user, and FIG. 3 is a top-down view of the tool. This embodiment includes a curvilinear grip 102 describing a partial semi-circle, and possibly with a flaring at either extremity of the grip (not shown), which results in a "saddle" for the hand in the extreme grip position. The grip 102 is somehow coupled to a blade 104 or other work-performing device. It will be appreciated that although the tool of FIGS. 1-3 is considered inventive in terms of the handle-blade combination, it is believed that the handle itself is inventive, and may be applied to different types of short-handled tools, including cultivators, weeders, hoes and so forth.

The embodiment of FIGS. 1-3 shows a primary line of attack 110 which intersects a portion of the grip and terminates at the tip of the tool. By virtue of the invention, the primary line of attack 110 runs from the tip of the tool through the elbow between the ulna and radius, such that the palm is naturally centered on the grip at a point centered on the line, as shown in FIG. 2. Note that in this position, the users hand is in a wrist-neutral position, which may be defined by an angle "a" of approximately 60 degrees between the user's first and the primary line of attack. The use of the inventive grip also allows the palm of the hand to slide or be repositioned along the grip throughout the natural arc of motion of the tool, with the wrist remaining at or near the wrist-neutral position.

The curved portion spans a semi-circle of 130 degrees, more or less. The radius to the outer surface of the grip is on the order of 3.5 to 5", and most preferably in the range of 3.625 to 4". The arc may be flattened slightly at any position along the length of the grip to correspond with a desired or different primary line of attack. The cross-sectional circumference of the grip along the semi-circular portion preferably ranges from 4 to 5 inches, or thereabouts. The grip may further be provided with a slight taper along its length, and where the circumference of the grip describes a flattened ellipsis where the wider portion of the flattened ellipsis (upon which the palm of the hand seats comfortably) runs along the exterior of. the grip length and the narrower portion of the flattened ellipsis (around which the fingers wrap comfortably) runs along the interior of the grip length.

In terms of materials, the shank of the handle may be a solid core of very low density, high tensile and shear strength metal, polypropylene, nylon or other thermoplastic, or may consist of a partially hollowed core with internal or external flanges or buttresses for strength. An exterior covering is preferably provided in the form of a thermoplastic elastomer such as Santoprene with a high friction coefficient, that may be brightly colored, and may have some surface texturing to increase friction, which texturing may consist of a relief-type design element. The covering may further contain areas with higher or lower coefficients of friction (for example, an area of softer or higher friction material seated under the center of the palm at the primary line of attack; or an area of harder or lower friction material along the sides of the grip to facilitate sliding or repositioning the hand on the grip); and may include a hole at the end to allow the tool to be hung from a hook or nail. The external covering preferably features a surface hardness on the exterior arc of the grip in the range of Shore A 50 to Shore A 65 and a surface hardness on the interior arc of the grip in the range of Shore A 45 to Shore A 60.

More broadly, the grip may be open or closed-ended, depending on design or other practical considerations. The invention may be implemented on short handled tools, such as trowels, cultivators, weeders, hoes and the like, as well as long-handled tools such as rakes, shovels, snow shovels, and so forth. Grips according to the invention may also be implemented on mid-length or telescoping versions of the short-handled tools. A quick-release version of the handle may be added to an existing tool with a straight shaft.

A larger semi-circular, closed-ended version of the grip with an arc on the order of 260 degrees to 300 degrees, may replace the traditional "D" handle on mid-length tools, such as shovels, spades, spading forks, and the like. The grip may be implemented at both ends of a "T" handle where the tool blade is rotated from side to side in a single plane to enhance the ergonomics of the attached tool; for example, on a long-handled bulb-planting tool.

Figure 4:
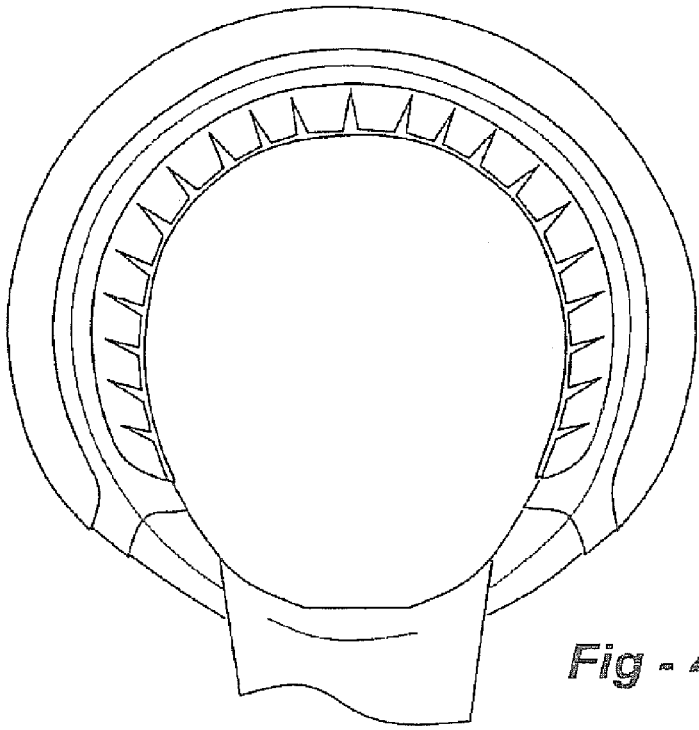
FIG. 4 is a drawing that shows an alternative embodiment of the invention.
Figure 5:
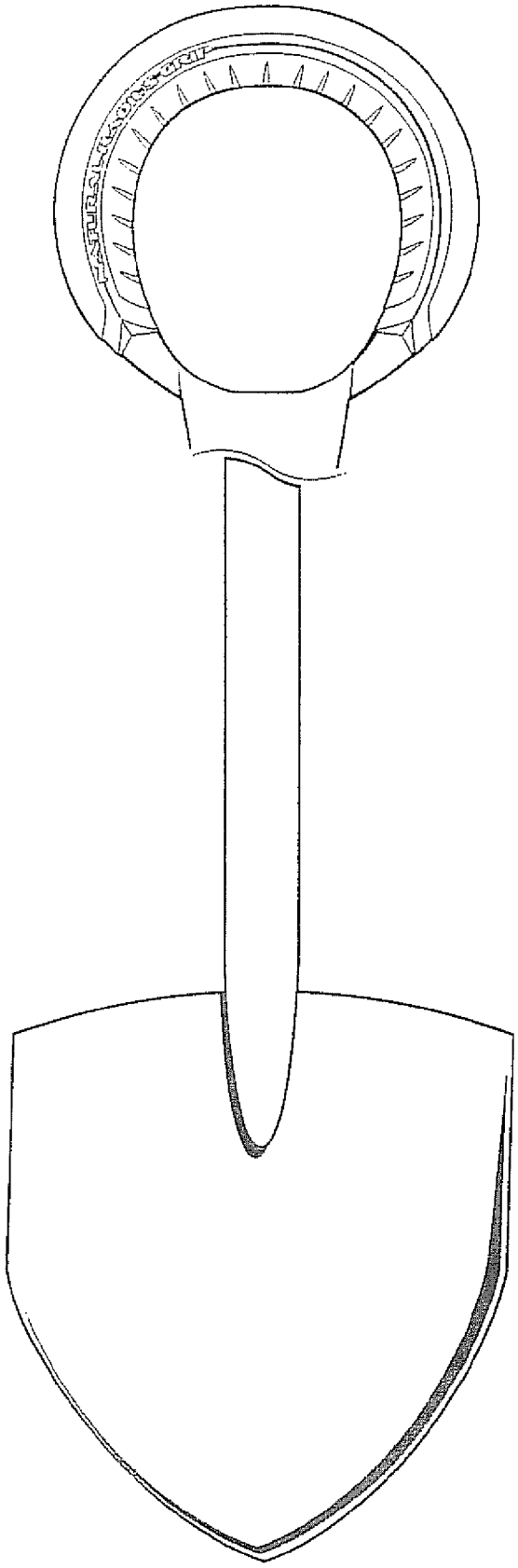
FIG. 5 is a drawing of a digging shovel utilizing the handle embodiment of FIG. 4.
Figure 6:
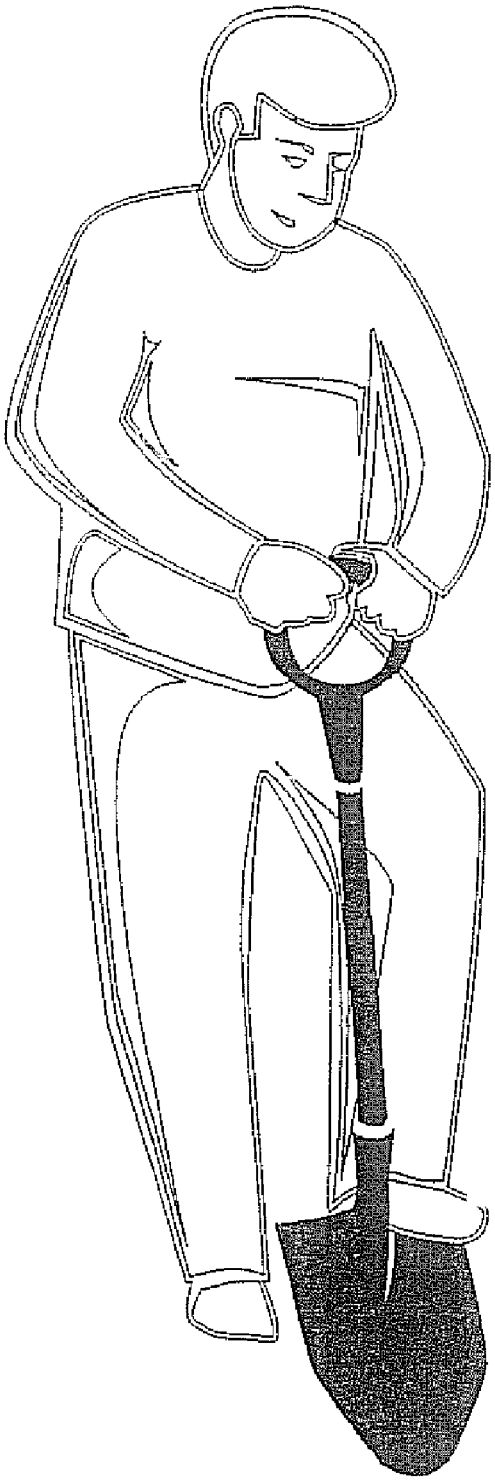
FIG. 6 is a drawing that shows the tool of FIG. 5 in use.
Figure 7:
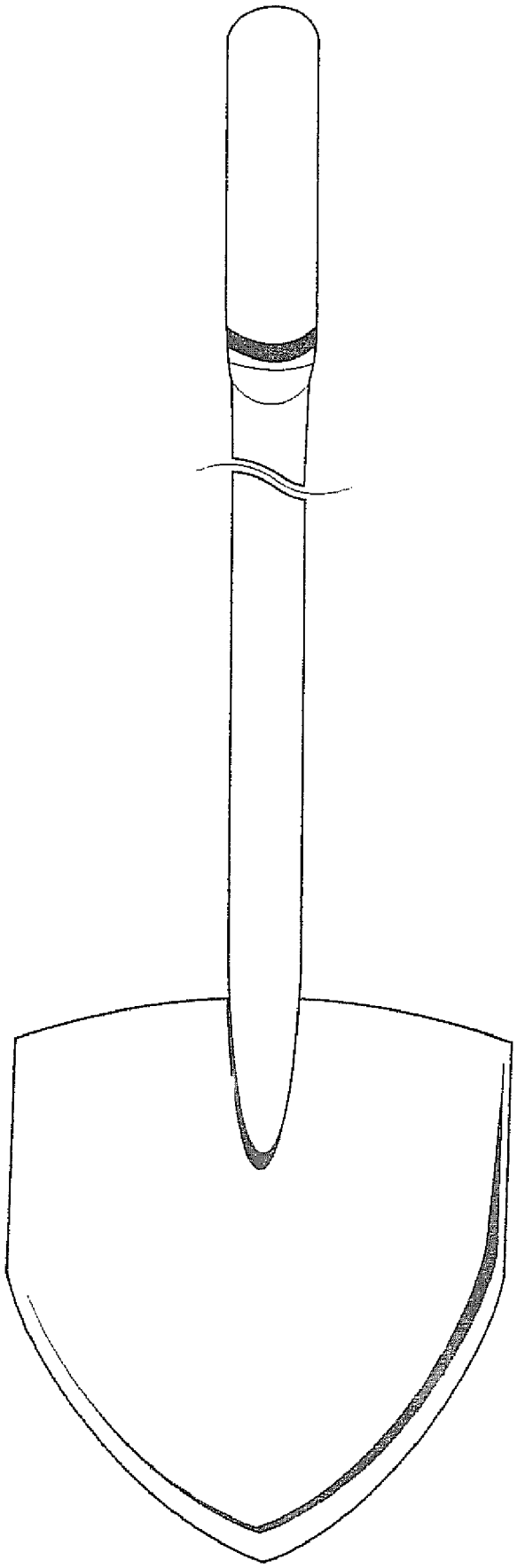
FIG. 7 is a drawing that shows the use of a circular grip on the digging shovel in a plane transverse to the blade of the tool.
Figure 8:
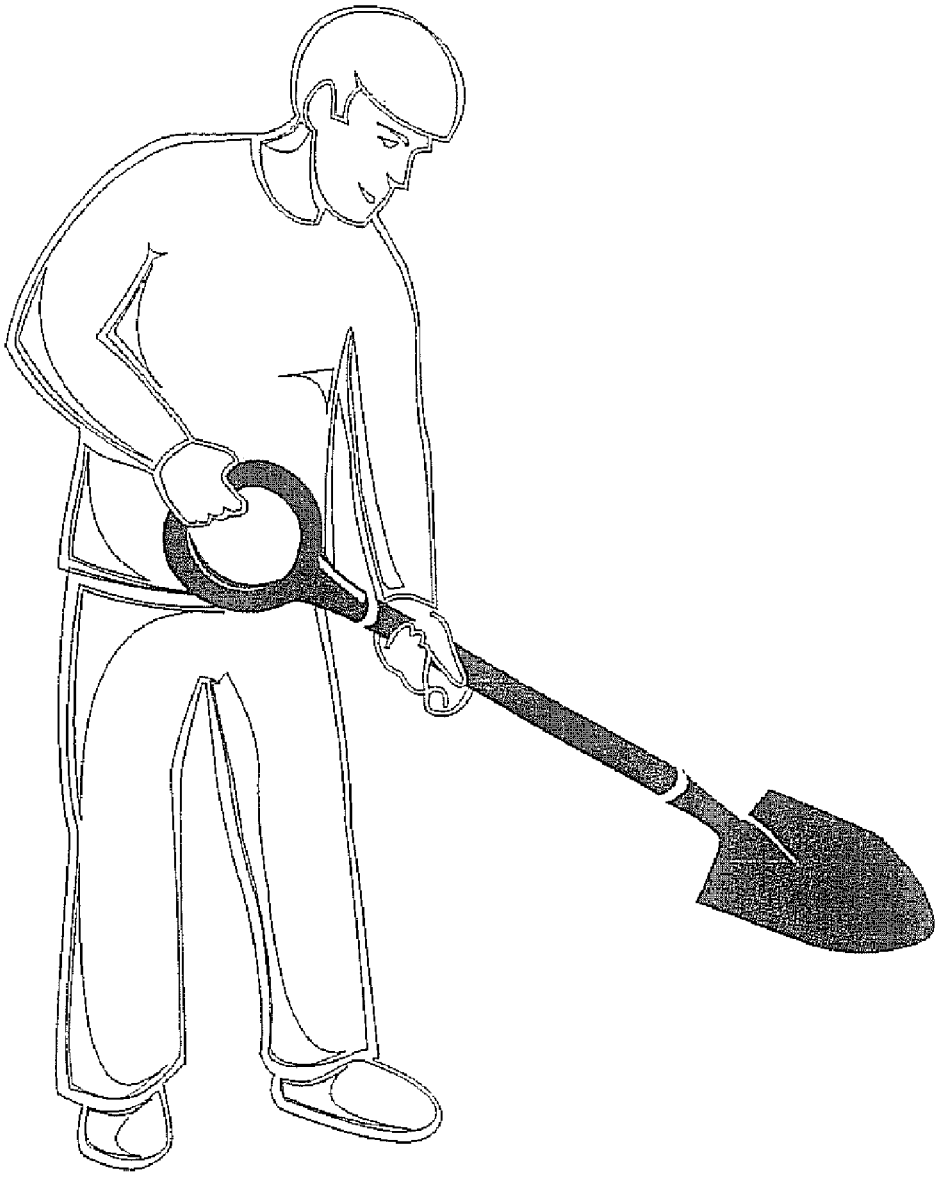
FIG. 8 is a drawing that shows the tool of FIG. 7 in use.
Figure 9:
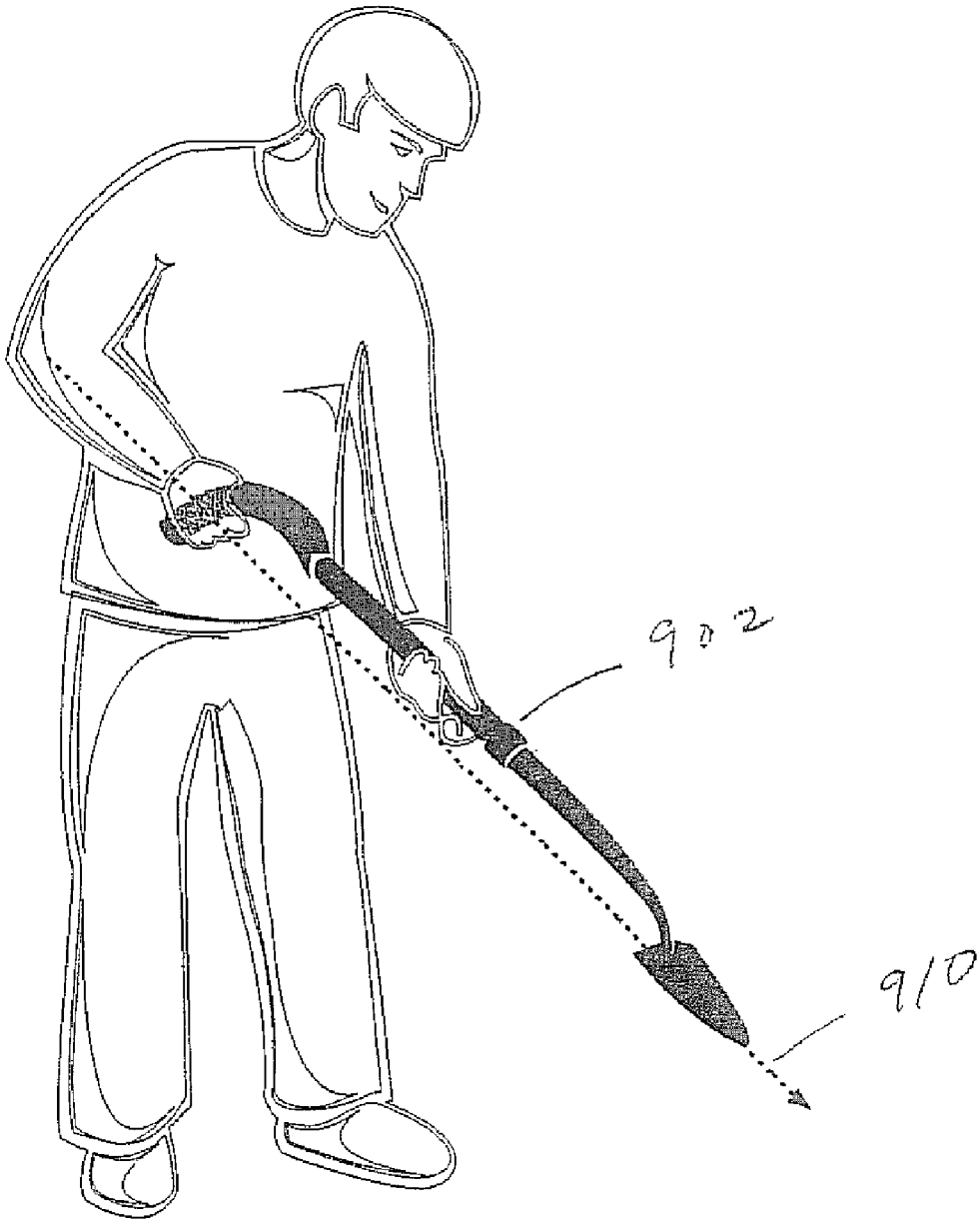
FIG. 9 is a drawing that shows handle according to the invention an extendable spade, also showing a line of attack.
Figure 10:
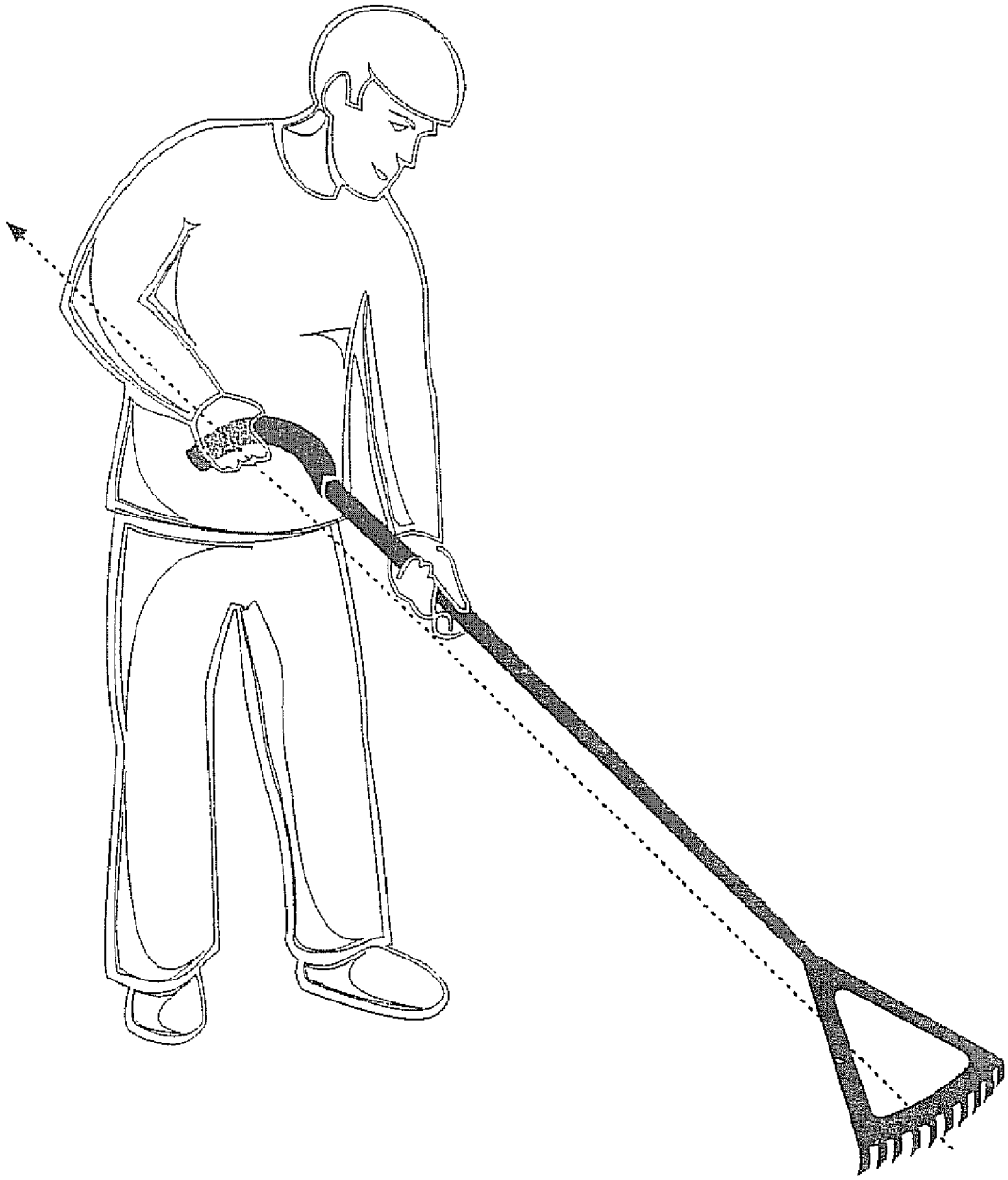
FIG. 10 if a drawing that shows a handle according to the invention on a pulling tool, in this case a rake, also showing the line of attack.

As discussed above, handles and grips according to this invention need not have a free end but, in fact, may assume the form of a full enclosed circle or oval shape, depending upon the application. FIG. 4, for example, illustrates a closed loop handle according to the invention, with the grip portion extending most of the way around the handle. FIG. 5 shows the handle of FIG. 4 with respect to a digging tool, in this case a spade. FIG. 6 is a drawing that shows an individual using the tool of FIG. 5. FIG. 7 is a drawing which shows the tool of FIGS. 5 and 6, but with a handle turned such that the plane of the grip is transverse to the plane of the blade, and FIG. 8 shows an individual using the handle of FIG. 7. With a rotating handle according to the invention, it may rotate freely or use click-stops at 90 degrees, for example. FIG. 9 is a drawing which shows a handle according to the invention in use with a longer digging tool, including an extension adjustment 902 with the line of attack being indicated at 910, and FIG. 10 illustrates the use of a handle according to the invention in conjunction with a pulling tool, in this case a rake, also showing the line of attack in broken-line form.

Figure 11:
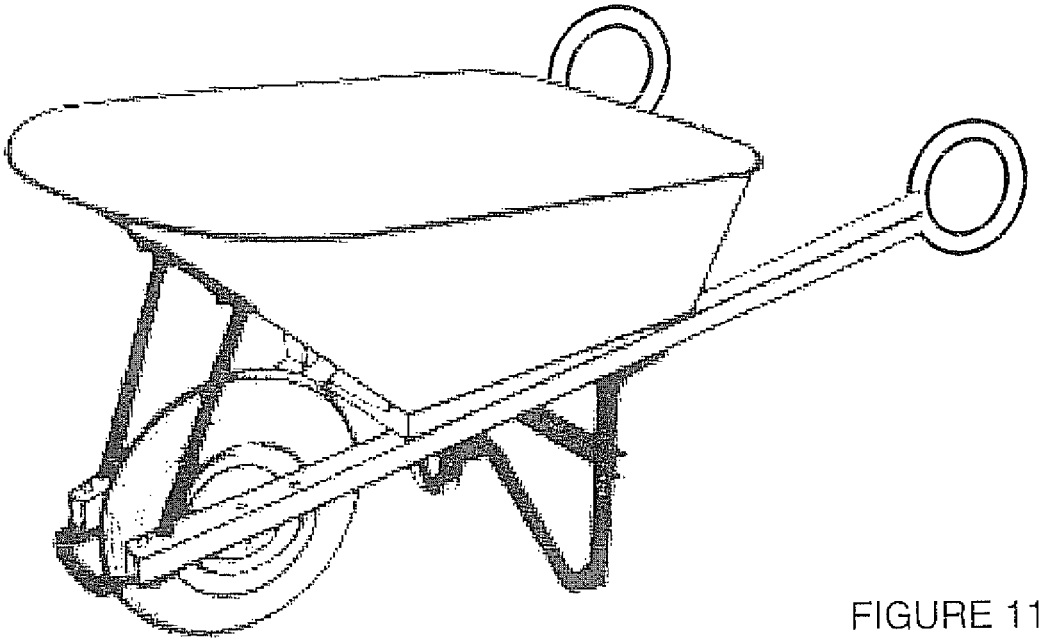
FIG. 11 is a drawing that shows how the invention may be applied to a cart, wheelbarrow or other implements.
Figure 12:
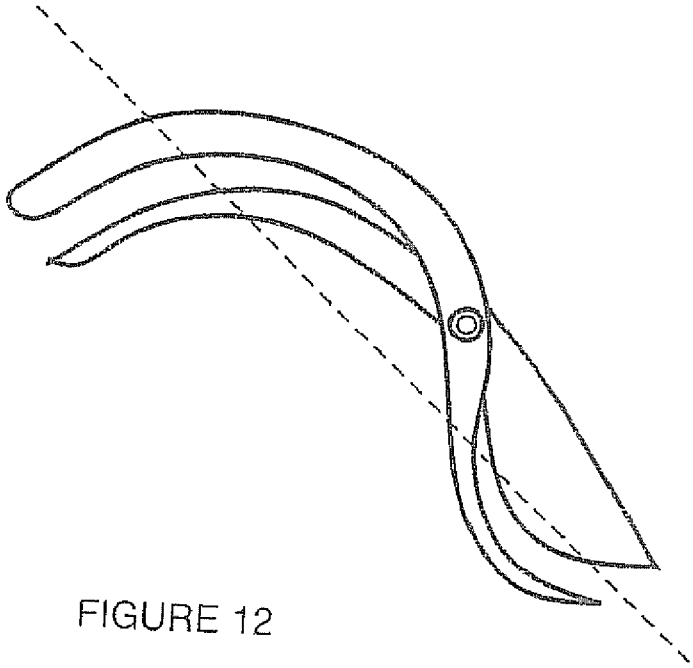
FIG. 12 is a drawing that shows how the invention may be applied to a scissor-type handle associated with pruning shears, for example.

FIG. 11 is a drawing that shows how the invention may be applied to a cart, wheelbarrow or other implements such as lopping shears. FIG. 12 is a drawing that shows how the invention may be applied to a scissor-type handle associated with pruning shears, for example.

I claim:

1. A short-handled, ergonomic garden tool, comprising:

an arc-shaped handle having a proximal section configured for gripping by a user and a distal end attached to a blade;

the handle being curved in a plane that bisects the blade into symmetrically opposing sides, the sides curving upwardly from a lower surface;

the lower surface being tangent to a plane along multiple points defining a straight line, the plane tangent to the lower surface of the blade further being perpendicular to the plane defined by the handle; and wherein the handle curves upwardly away from the blade and above the plane tangent to the lower surface, then downwardly past and below the plane tangent to the lower surface, enabling a user to grip the proximal section of the handle in a wrist-neutral position with the user's forearm in general alignment with the blade.

2. The short-handled, ergonomic garden tool of claim 1, wherein the handle defines a circular arc with a center below the plane tangent to the scoop portion.

3. The short-handled, ergonomic garden tool of claim 2, wherein the circular arc has a radius on the order of 3 to 4 inches.

4. The short-handled, ergonomic garden tool of claim 1, wherein the gripping section of the handle has a cross-sectional circumference in range from 3.5 to 5 inches.

5. The short-handled, ergonomic garden tool of claim 1, wherein the gripping section of the handle includes a slight taper along its length.

6. The short-handled, ergonomic garden tool of claim 1, wherein the gripping section of the handle includes a polymeric covering.

7. The short-handled, ergonomic garden tool of claim 1, wherein: the blade defines a primary line of attack; and the user's forearm is aligned along the line of attack when held in the wrist-neutral position.

8. The short-handled, ergonomic garden tool of claim 1, wherein the blade forms a cultivator.

9. The short-handled, ergonomic garden tool of claim 1, wherein the blade forms a weeder.

10. The short-handled, ergonomic garden tool of claim 1, wherein the blade forms a hoe.

* * * * *